US006678899B2

(12) United States Patent
Fiorini et al.

(10) Patent No.: US 6,678,899 B2
(45) Date of Patent: Jan. 20, 2004

(54) CHEST PROTECTOR

(75) Inventors: Jeffrey L. Fiorini, Norcross, GA (US); Shingo Nemoto, Norcross, GA (US); Masao Nagai, Norcross, GA (US); Shigeki Kuroda, Osaka (JP)

(73) Assignee: Mizuno Corporation, Osaka (JP)

( * ) Notice: Subject to any disclaimer, the term of this patent is extended or adjusted under 35 U.S.C. 154(b) by 0 days.

(21) Appl. No.: 09/910,484

(22) Filed: Jul. 20, 2001

(65) Prior Publication Data

US 2003/0024035 A1 Feb. 6, 2003

(51) Int. Cl.[7] ..... A41D 13/00
(52) U.S. Cl. ..... 2/463; 2/92
(58) Field of Search ..... 2/463, 455, 461, 2/2.5, 462, 92, 102, 465, 44, 45, 46, 96, 913, 326, 327, 50, 52, 114; 128/95.1, 96.1, 99.1, 100.1, 101.1, 106.1, 107.1, 112.1, 874; 602/20, 23, 61

(56) References Cited

U.S. PATENT DOCUMENTS

| | | | | | |
|---|---|---|---|---|---|
| 295,543 | A | * | 3/1884 | Gray | 2/463 |
| 2,756,429 | A | | 7/1956 | Malachowski | |
| 3,125,762 | A | * | 3/1964 | Glahe | 2/463 |
| 3,257,666 | A | | 6/1966 | Hoffman | |
| 4,272,847 | A | * | 6/1981 | Buhler | 2/463 |
| 4,525,875 | A | | 7/1985 | Tomczak | |
| 4,573,216 | A | | 3/1986 | Wortberg | |
| 5,245,706 | A | | 9/1993 | Moschetti et al. | |
| 5,353,437 | A | | 10/1994 | Field et al. | |
| 5,530,966 | A | | 7/1996 | West | |
| 5,623,729 | A | * | 4/1997 | Chen | 2/461 |
| 5,652,967 | A | * | 8/1997 | Hsu | 2/463 |
| 5,669,080 | A | | 9/1997 | Culton | |
| 5,973,247 | A | | 10/1999 | Matthews | |
| 6,070,273 | A | | 6/2000 | Sgro | |
| 6,161,226 | A | | 12/2000 | Serewicz et al. | |
| 6,182,299 | B1 | * | 2/2001 | Chen | 2/463 |

* cited by examiner

*Primary Examiner*—Tejash Patel
(74) *Attorney, Agent, or Firm*—Troutman Sanders LLP; Gerald R. Boss, Esq.; Ryan A. Schneider, Esq.

(57) ABSTRACT

A form-fitting chest protector. In one embodiment, the chest protector includes a pair of detachably secured wing portions. A main portion of the chest protector has a variable thickness and substantially overlies the chest and abdomen of the athlete to absorb impacts to the athlete from a projectile. The wing portions are separate from the main portion, but are detachably secured to the chest protector to permit each wing portion to be adjustable when the chest protector is worn by the athlete. The wing portions facilitate a constant form-fit no matter how the body of the athlete flexes.

13 Claims, 5 Drawing Sheets

CHEST PROTECTOR

TECHNICAL FIELD

This invention relates in general to a form-fitted chest protector for athletes and more particularly to increasing the amount of protection for the athlete without compromising the athlete's mobility.

BACKGROUND OF THE INVENTION

Padded chest protectors for baseball catchers are known in the athletic equipment industry. Known chest protectors include a main padded portion shaped to overlay the athlete's chest and abdomen. The main padded portion is a uniform thickness and is semi-rigid to conform to the catcher's chest and abdomen. However, the main padded portion is sufficiently impact-resistant to absorb the impact of a baseball.

Chest protectors also include a plurality of adjustable straps for securing the chest protector to the catcher. One set of straps extend over the catcher's shoulders and another set of straps extend around the catcher's sides. The two sets of straps extend to the catcher's back where the straps are secured to one another.

Chest protectors may also include a protective shoulder wing extending outward from the main padded portion and over the juncture between the upper arm and the shoulder. Typically, the wing is only used on one side of the chest protector to protect the catcher's throwing arm. However, the wing is not directly attached to the athlete's throwing arm so as to not obstruct forward arm movement.

Some known chest protectors may also include a pair of protective side portions integrally formed with the main padded portion. For example, U.S. Pat. No. 4,272,847 to Buhler discloses a chest protector having extensions 16 extending from chest protecting portion 12. The extensions 16 are defined by the greater width of the chest protecting portion 12. The protective side extensions 16 extend around the catcher's sides toward the catcher's hips. Typically, protective side portions such as extensions 16 are made of the same padding material and are the same thickness as the main padded portion over the chest.

Known chest protectors are usually manufactured in only a few different sizes and, therefore, a suitable chest protector cannot be found for all athletes. In particular, the protective side portions are a fixed size and extend from the main padded portion in a fixed manner. These known protective side portions are not adjustable. Consequently, a catcher may not be adequately protected because of the many different shapes and sizes of today's baseball players.

Accordingly, there is a need for a chest protector suitable for many different sizes of catchers. The chest protector must provide protective side portions which extend from the main padded portion along the catcher's side in an adjustable manner without compromising the catcher's mobility or flexibility. Moreover, the new chest protector must provide increased protection for the chest from impacting baseballs.

Additionally, chest protectors are generally loose fitting and designed solely to protect the frontal portion of a catcher. Accordingly, with the dynamic positioning of the catcher, these chest protectors will move about requiring the catcher to constantly reposition the chest protector into position.

Thus, there is also a need for a close-fitting chest protector which will generally maintain a protective position while not interfering with the catcher's movements.

SUMMARY OF THE INVENTION

The present invention solves the above-identified problems by providing a chest protector with increased padding and which is adapted to cover more of the athlete's body in a tailored manner. This new chest protector is suitable for use with athletes of many different sizes, while extending more completely around the sides of the athlete's body providing a secure fit.

Generally described, the present invention includes a chest protector having a pair of detachably secured wing portions. A main portion of the chest protector substantially overlies the chest and abdomen of the athlete. The chest protector also has a variable thickness; providing thicker padding in areas more likely to incur impacts and thinner padding in areas less likely to incur impacts. The detachable wing portions are separate from the main portion, but may be attached to the chest protector to permit each wing portion to be adjustable when the chest protector is worn by the athlete.

In one embodiment of the invention, the main portion of the chest protector also includes a plurality of fold lines defining raised impact-absorbing surfaces therebetween. The raised impact-absorbing surfaces each include a downward-deflecting surface for directing an incoming projectile downward towards a general area after the projectile impacts the chest protector whereby the catcher may quickly locate the projectile.

The foregoing has broadly outlined some of the more pertinent aspects and features of the present invention. These should be construed to be merely illustrative of some of the more prominent features and applications of the invention. Other beneficial results can be obtained by applying the disclosed information in a different manner or by modifying the disclosed embodiments. Accordingly, other aspects and a more comprehensive understanding of the invention may be obtained by referring to the detailed description of the exemplary embodiments taken in conjunction with the accompanying drawings, in addition to the scope of the invention defined by the claims.

BRIEF DESCRIPTION OF THE DRAWINGS

Similar reference characters refer to similar parts throughout the several views of the drawings.

DESCRIPTION OF A PREFERRED EMBODIMENT

Figure 1:
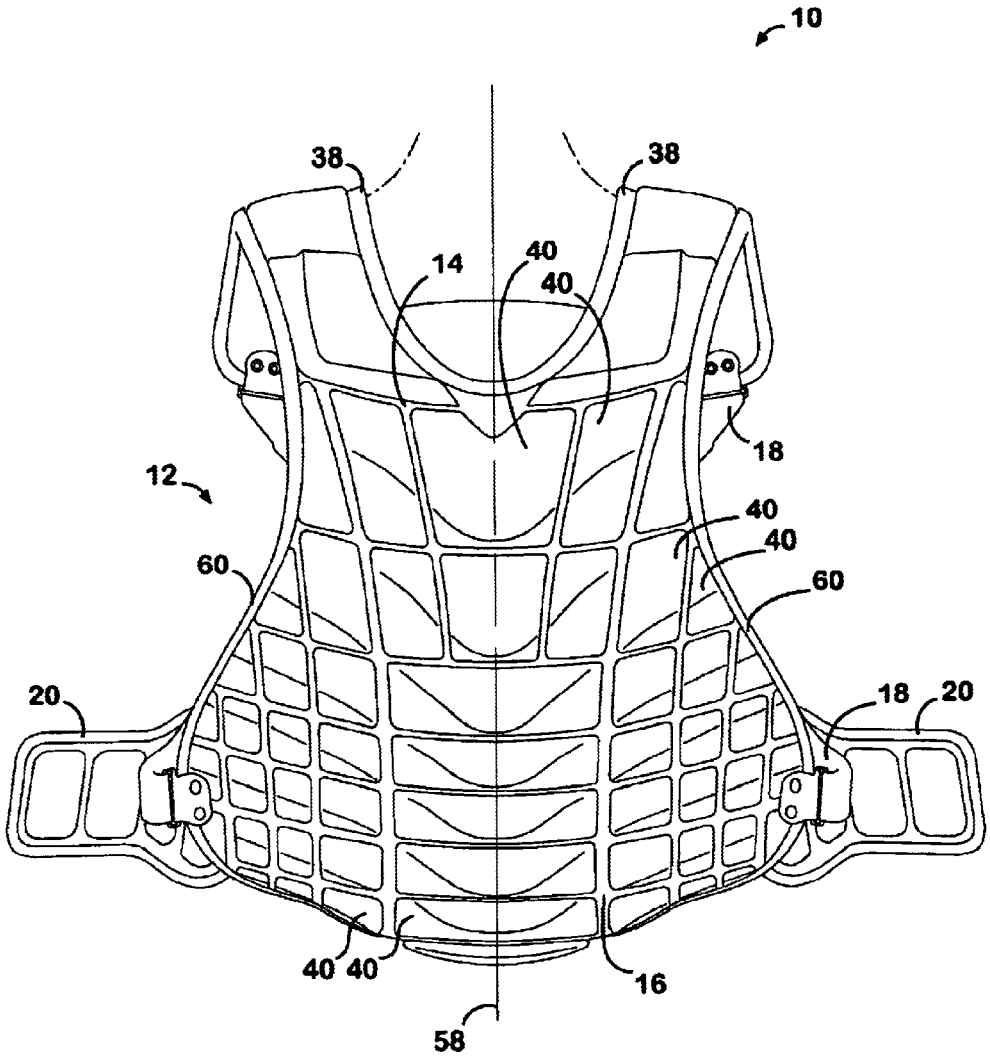
FIG. 1 is a front perspective view of one embodiment of a chest protector according to the present invention.

Referring now to the drawings in which like numerals indicate like elements throughout the several views, FIG. 1 illustrates an exemplary embodiment of a chest protector 10 of the present invention. The chest protector 10 may be for a baseball catcher or for some other type of athlete requiring protection of the torso area including the chest, shoulders, abdomen and waist.

Figure 2:
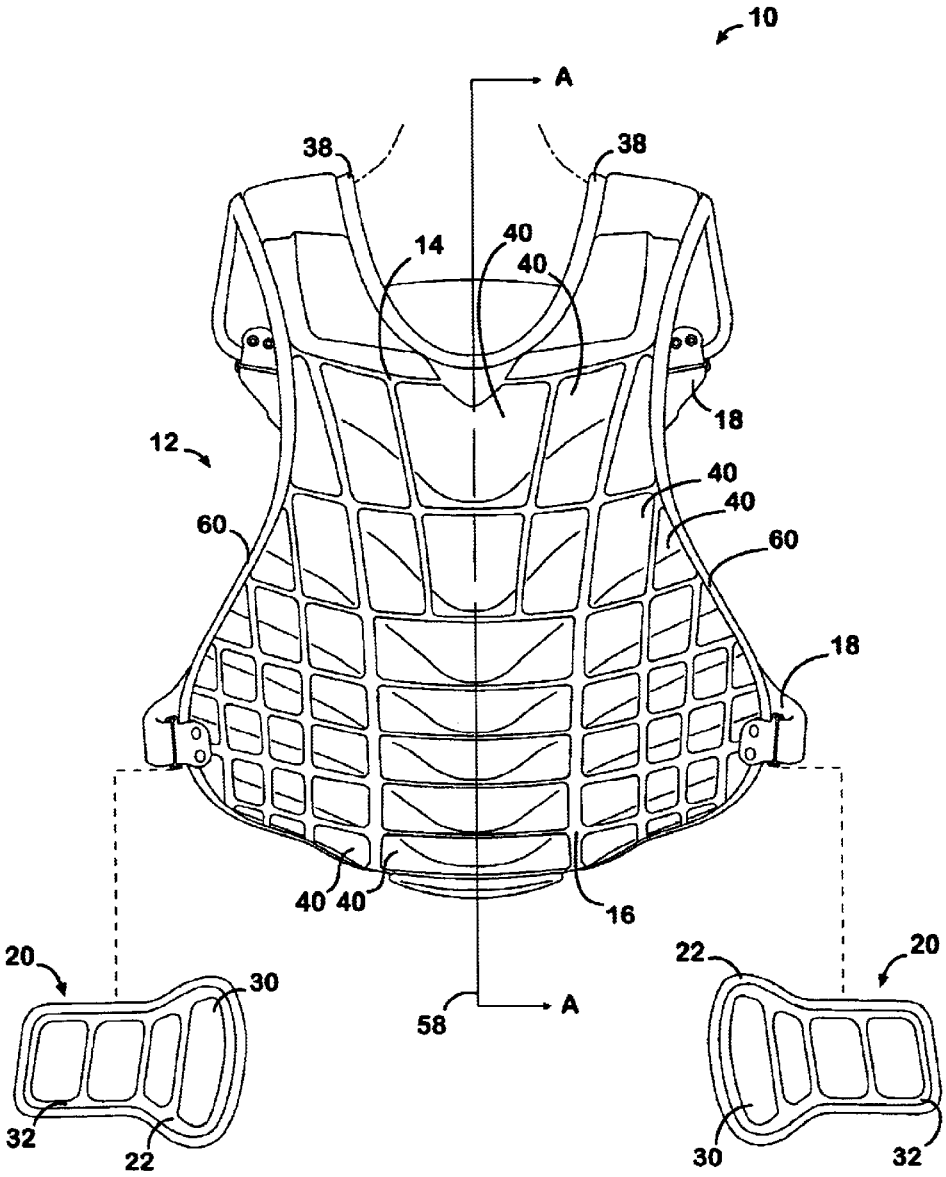
FIG. 2 is a partially exploded perspective view of the chest protector of FIG. 1.

As best shown in FIGS. 1 and 2, the chest protector 10 includes a main padded portion 12. The main portion 12 of the chest protector 10 is preferably non-elastic and includes an upper portion 14 for protecting the chest area and a lower portion 16 for protecting the abdomen. The chest protector 10 also includes a plurality of adjustable straps 18 for securing the chest protector 10 to the catcher. One set of the straps 18 extends from the portions of the chest protector 10 extending over the catcher's shoulders and another set of the straps 18 overlaps the portions of the chest protector 10 extending around the catcher's sides. The two sets of straps 18 extend to the catcher's back where the straps 18 are secured to one another.

Figure 3:
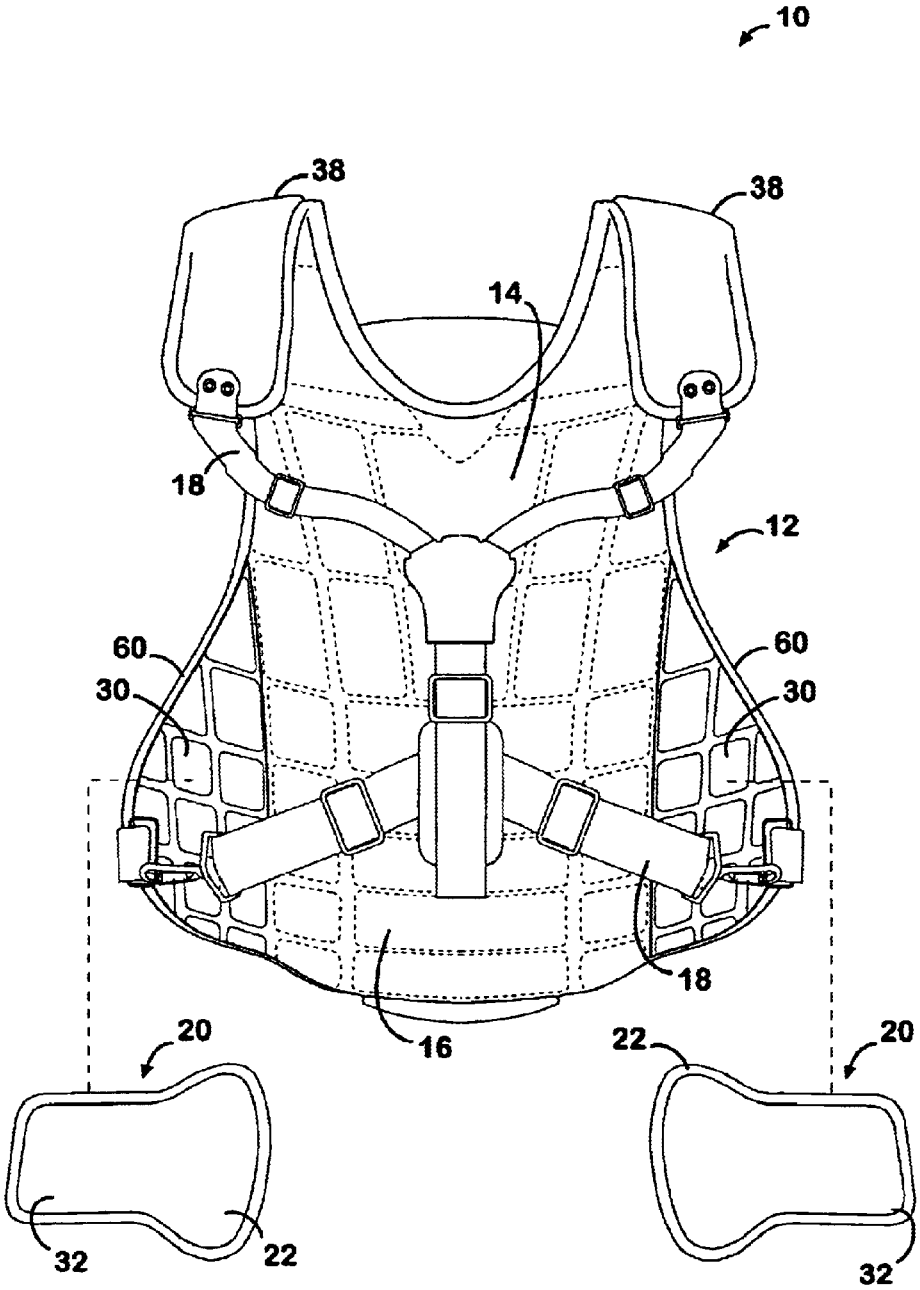
FIG. 3 is a back perspective view of the chest protector of FIG. 1 illustrating detached wing portions according to the present invention.

The chest protector 10 further includes a pair of elongated wing portions 20. The wing portions 20 may be integral to the main portion 12 or separate from the main portion 12. The wing portions 20 are also preferably non-elastic. The wing portions 20 may be any shape but are configured to conform to and wrap around the sides of the athlete when the chest protector 10 is being worn and are adjustable in that they may be detachably secured to the main portion 12 in a plurality of positions. In other words, each of the wing portions 20 may be detached from the main portion 12 and then reattached on the main portion 12 in a different position. FIGS. 2 and 3 best illustrates the wing portions 20 detached from the main portion 12. The length and orientation of each wing portion 20 relative the main portion 12 may be changed by repositioning the wing portions 20 on the main portion 12.

Proximal ends 22 of the wing portions 20 are detachably secured to the back of the main portion 12 of the chest protector 10 with fasteners capable of permitting the wing portion 20 to be firmly attached, while the chest protector 10 is being worn, but then easily detached after the athlete removes the chest protector 10. Otherwise, the wing portions 20 are free of any means for permanent attachment to the main portion 12 of the chest protector 10. Preferably, hook and loop fasteners 30 are used on the front and back of the wing portions 20 and lower portion of the chest protector 10, respectively. Alternatively, snaps, buttons, pins, laces, zippers or any equivalents thereof may be used to detachably secure the wing portions to the main portion 12.

Figure 4:
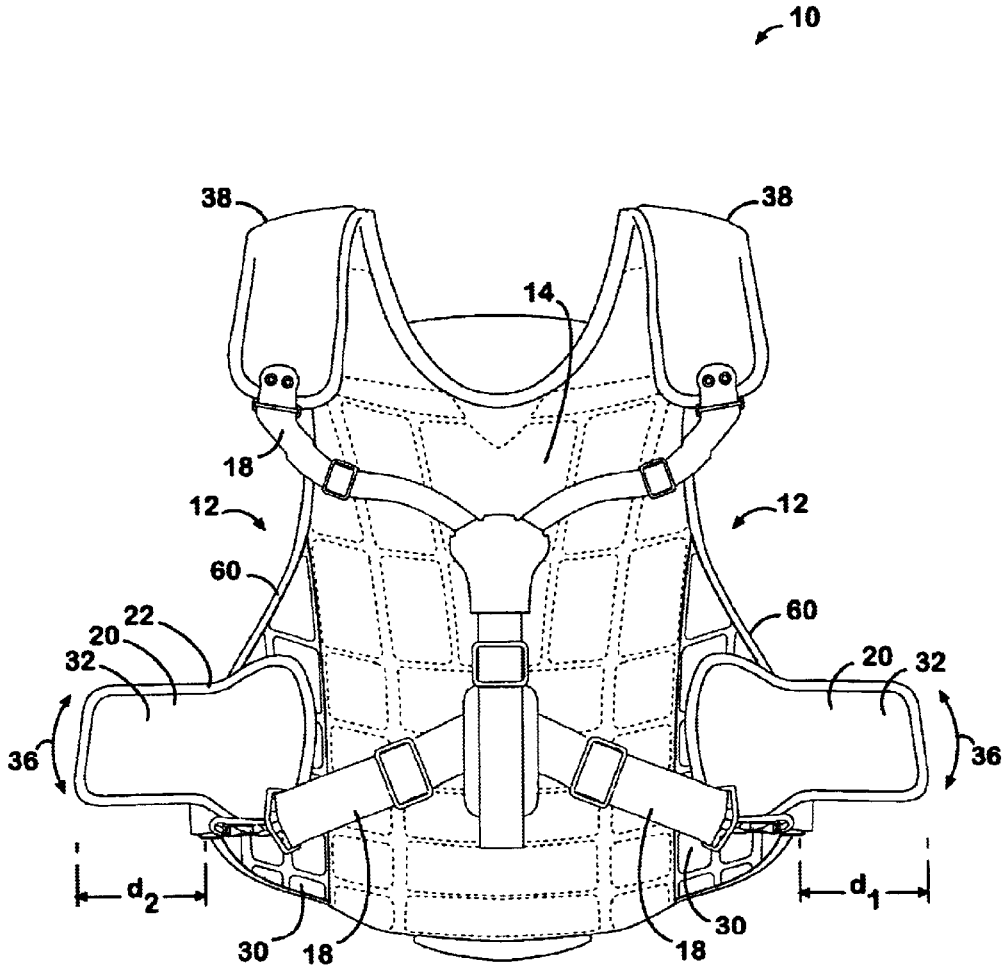
FIG. 4 is a back perspective view of the chest protector of FIG. 1 illustrating the wing portions attached according to the present invention.

Hook and loop fasteners 30 on the back of the lower portion of the chest protector 10 are best shown in FIGS. 3 and 4. The hook and loop fasteners 30 should be provided on a large enough area on the lower portion 16 of the chest protector 10 as well as on the proximal ends 22 of the wing portions 20 so that the extent which distal ends 32 of the wing portions 20 extend from the back of the chest protector 10 is variable.

For example, FIG. 4 illustrates the distal ends 32 of the wing portions 20 laterally displaced from the main portion 12 of the chest protector 10. The wing portion 20 on the right in a first position extends a distance $d_1$ from the edge of the main portion 12 of the chest protector 10. The other wing portion 20 on the left extends a distance $d_2$ from the edge of the main portion 12 of the chest protector 10. Note that arrows having reference number 36 indicate that each of the wing portions 20 may also be oriented to extend in a different direction.

The chest protector 10 also includes two laterally spaced upper extensions 38 that are adjacently disposed to the shoulders of the catcher. The upper extensions 38 extend over the top of the catcher's shoulders. Preferably, the upper extensions 38 are integral with the main padded portions 12 and are made of the same material as main padded portion 12. The wing portions 20 are designed to overlay the sides and lower back portion of the catcher to facilitate a continuous form-fit no matter how the athlete flexes. When utilized with straps 18, wings 20 encircle the sides of the catcher forming a semi-circle. With the wing portions 20 in place, and the cooperation of upper extensions 38 over the catcher's shoulders, the protector 10 becomes form-fitting with the straps 18 tensioning the opposite wing portions 20 toward each other to maintain the form-fit. Hence, a lateral force is applied via the straps 18 for maintaining the chest protector 10 in place restricting lateral movement, thereby maintaining the abdomen portion of the chest protector 10 in place where it is needed. Preferably, when utilizing straps 18, ends of the straps are attached to the upper extensions 38 and to the lower portion 16 of the chest protector 10, while the chest protector 10 is worn, the straps 18 attached to the lower portion 16 overlap at least a portion of each of the wing portions 20 to facilitate a snug fit. In some embodiments, the vertical height of each of the wing portions is increased to permit a portion of the wing portions 20 to extend between each of the athlete's hips and arm pits and to preferably extend to the athlete's latisimus dorsi.

Figure 5:
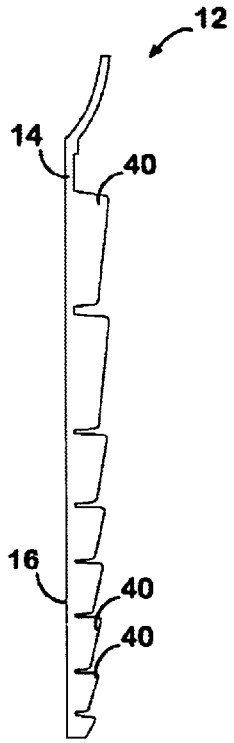
FIG. 5 is a cross-sectional view of one embodiment of the chest protector of the present invention taken along line A—A in FIG. 2.

Referring now to FIG. 5, the main portion 12 of the chest protector 10 has a variable thickness so that more protection is provided at the upper portion 14 than at the lower portion 16 of the chest protector 10. More protection is need in the upper portion 14 because the upper portion 14 is more likely to be impacted by an incoming projectile, when the catcher is in the normal catching position, whereas the lower portion 16 should be more flexible to permit the athlete to bend and rotate at the waist. Each of the upper and lower portions may also be thicker near the center, compared to their edges.

Figure 6:
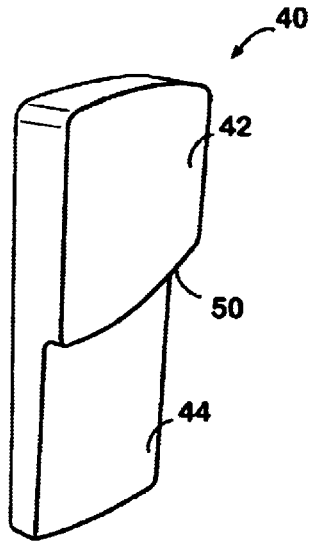
FIG. 6 is a perspective view of one embodiment of a raised impact-absorbing portion of the chest protector according to the present invention.

On the front of the chest protector 10 is a plurality of intersecting fold lines which provide some flexibility to the main portion 12 of the chest protector 10. Preferably, each of the fold lines is substantially channel-shaped. The intersecting fold lines define a plurality of raised impact-absorbing surfaces 40. FIG. 6 illustrates a perspective view of a raised impact absorbing surface 40. Each of the raised impact-absorbing surfaces is configured for receiving the impact of an incoming projectile.

In particular, each of the raised impact-absorbing surfaces 40 define an upper surface portion 42 and a lower surface portion 44. When the chest protector 10 is being worn, it can be seen that the upper surface portion 42 of each raised impact-absorbing surface 40 is positioned over the top of the corresponding lower surface portion 44. Also, each upper surface portion 42 has a greater height relative to the lower surface portion 44. For example, in FIG. 7, the upper surface portion 44 has a height $h_1$ and the lower surface portion 44 has a height $h_2$ where $h_1$ is greater than $h_2$.

Figure 7:
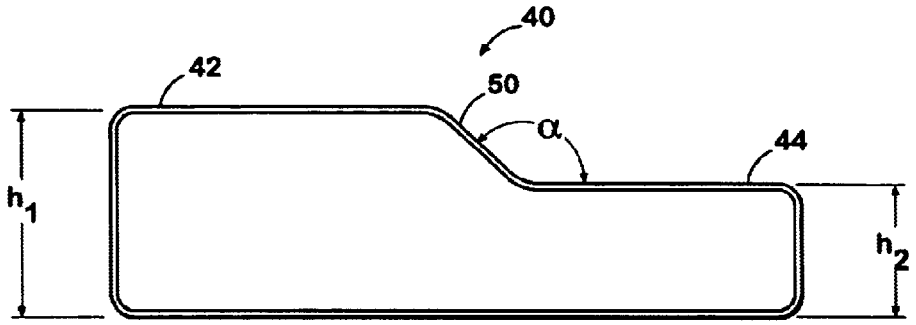
FIG. 7 is a side view of the raised-impact absorbing portion of FIG. 6.

The upper and lower surface portions 42 and 44 merge into one another to define a downwardly-deflecting portion 50 between each corresponding upper and lower surface portion. As best shown in FIG. 7, the angle of each downward-deflecting portion 50 is to direct the incoming projectile downward when the projectile impacts the raised impact-absorbing surface 40. The incoming projectile may impact more than one raised impact-absorbing surface 40 and the cumulative effect is still to deflect the projectile downward.

Preferably, as shown in FIGS. 1 and 2, the raised impact-absorbing surfaces 40 have surface areas incrementally decreasing in size from the upper portion 14 of the main portion 12 to the lower portion 16 of the main portion. However, there is a greater number of raised impact-absorbing surfaces 40 on the lower portion 16 because of their reduced size. Because the impact-absorbing surfaces 40 are smaller on the lower portion 16 of the chest protector 10, there is greater flexibility in the lower portion 16 of the chest protector 10. The surface areas of the raised-impact-absorbing surfaces also preferably decrease in size laterally from a vertical center line 50 through the main portion 12 of the chest protector 10 to the vertical side edges 60 of the main portion 12 as shown in FIG. 1.

The present invention has been illustrated in relation to particular embodiments which are intended in all respects to be illustrative rather than restrictive. Those skilled in the art will recognize that the present invention is capable of many modifications and variations without departing from the scope of the invention. Accordingly, the scope of the present invention is described by the claims appended hereto and supported by the foregoing.

What is claimed is:

1. A chest protector for absorbing impacts to the body of an athlete from a projectile, comprising:

a main portion for substantially overlaying the chest and abdomen of the athlete;

a pair of wing portions detachably secured to said main portion, each said wing portion configured to overlay the sides and lower back portion of the athlete to facilitate a continuous form-fit; and a plurality of adjustable straps coupled to said main portion, said straps adjusted to at least partially overlap said wing portions when the chest protector is worn and said straps tensioning the wing portions toward each other to maintain the form fit.

2. The chest protector of claim 1, wherein said chest protector is substantially non-elastic.

3. The chest protector of claim 1 wherein said wing portion is detachably secured to a back of the main portion.

4. A chest protector for absorbing impacts to the body of an athlete from a projectile, comprising:

a main portion for substantially overlying the chest and abdomen of the athlete; and a pair of adjustable wing portions separate from said main portion, each said wing portion padded and having proximal and distal ends, said proximal ends detachably secured to said main portion to permit each said distal end to be displaced a plurality of distances from said main portion, and each said wing portion generally conforming to one of the sides and lower back portion of the athlete when detachably secured to said main portion and said chest protector is worn by the athlete.

5. The chest protector of claim 4 wherein said distal end of one of said wing portions extends a distance $d_1$ from said main portion and said distal end of the other of said wing portions extends a distance $d_2$ from said main portion.

6. The chest protector of claim 4 further comprising a pair of laterally spaced upper extensions extending from said main portion and adapted to be adjacently disposed to the shoulder of the athlete, said upper extensions cooperating with said wing portions to form-fit said chest protector to the athlete.

7. The chest protector of claim 4 wherein one of said wing portions having been detached from a first position on said main portion is reattached in a second position on said main portion.

8. The chest protector of claim 4 further comprising fastening means carried on said wing portions and said main portion for detachably securing each of said wing portions to said main portion.

9. The chest protector of claim 8 wherein said fastening means comprises hook and loop fasteners for detachably securing said wing portions to said main portion.

10. The chest protector of claim 8 wherein said wing portions are otherwise free of means for permanent attachment of said wing portions to said main portion.

11. The chest protector of claim 4 wherein said wing portion is detachably secured to a back of the main portion.

12. A chest protector for absorbing impacts to the body of an athlete from a projectile, comprising:

a main portion for substantially overlaying the chest and abdomen of the athlete, said main portion comprising a pair of laterally spaced upper extensions extending from said main portion, said upper extensions adapted to be adjacently disposed to the shoulders of the athlete and to extend over the shoulders of the athlete;

a pair of adjustable wing portions separate from said main portion, each said wing portion having proximal and distal ends, said proximal ends detachably secured to said main portion to permit each said distal end to be displaced a plurality of distances from said main portion, and each said wing portion generally conforming to one of the sides of the athlete when detachably secured to said main portion and said chest protector is worn by the athlete; and a plurality of adjustable straps coupled to said upper extensions and adapted to at least partially overlap said wing portions such that said chest protector is form-fitted to the athlete while the chest protector is worn.

13. The chest protector of claim 1 said wing portion is detachably secured to a back of the main portion.

* * * * *